US006039772A

United States Patent [19]

Orr

[11] Patent Number: 6,039,772

[45] Date of Patent: Mar. 21, 2000

[54] NON LEADED FUEL COMPOSITION

[76] Inventor: William C. Orr, 1242 S. Gilpin, Denver, Colo. 80210

[21] Appl. No.: 08/421,281

[22] Filed: Apr. 13, 1995

Related U.S. Application Data

[63] Continuation of application No. 07/511,896, Apr. 10, 1990, abandoned, which is a continuation of application No. 06/770,836, Aug. 28, 1985, abandoned, which is a continuation-in-part of application No. 06/670,556, Oct. 9, 1984, abandoned.

[51] Int. Cl.[7] ..... C10L 1/12; C10L 1/18

[52] U.S. Cl. ..... 44/359; 44/446; 44/447; 44/448; 44/451; 44/452

[58] Field of Search ..... 44/359, 446, 447, 44/448, 451, 452

[56] References Cited

U.S. PATENT DOCUMENTS

| | | | |
|---|---|---|---|
| Re. 29,488 | 12/1977 | Gautreaux | 44/360 |
| 1,388,531 | 8/1921 | Stevens . | |
| 1,761,810 | 6/1930 | Bjerregaard | 44/78 |
| 1,884,559 | 10/1932 | Calcott et al. | 44/78 |
| 1,945,521 | 2/1934 | Downing et al. | 44/78 |
| 1,995,615 | 3/1935 | Jaeger | 44/70 |
| 2,014,200 | 9/1935 | Downing et al. | 44/78 |
| 2,021,088 | 11/1935 | Pevere | 44/72 |
| 2,088,000 | 7/1937 | Savage . | |
| 2,324,118 | 7/1943 | Sweney | 44/72 |
| 2,331,386 | 10/1943 | Gaylor | 44/387 |
| 2,334,006 | 11/1943 | Holm | 44/70 |
| 2,343,766 | 3/1944 | Gaylor | 44/387 |
| 2,391,084 | 12/1945 | Carmody | 44/449 |
| 2,409,746 | 10/1946 | Evans et al. | 44/449 |
| 2,726,942 | 12/1955 | Arkis | 44/56 |
| 2,818,417 | 12/1957 | Brown et al. | 44/68 |
| 2,874,033 | 2/1959 | Serniuk et al. | 44/56 |
| 2,913,413 | 11/1959 | Brown | 44/68 |
| 3,001,941 | 9/1961 | Dille | 252/56 |
| 3,030,195 | 4/1962 | Ewan | 44/69 |
| 3,110,577 | 11/1963 | Brown et al. | 44/68 |
| 3,127,351 | 3/1964 | Brown et al. | 44/359 |
| 3,153,901 | 10/1964 | Rifkin | 44/68 |
| 3,177,653 | 4/1965 | Barnes et al. | 60/35.4 |
| 3,211,071 | 10/1965 | Bolsey et al. | 95/64 |
| 3,221,071 | 11/1965 | Stahly . | |
| 3,224,848 | 12/1965 | Henderson | 44/56 |
| 3,244,736 | 4/1966 | Coffield et al. | 44/68 |
| 3,261,674 | 7/1966 | Condo | 44/69 |
| 3,272,606 | 9/1966 | Brown et al. | 44/359 |
| 3,300,287 | 1/1967 | Savage | 44/50 |
| 3,314,884 | 4/1967 | Cover | 252/10 |
| 3,316,168 | 4/1967 | Mernitz | 208/17 |
| 3,346,648 | 10/1967 | Worrel | 260/611 |
| 3,382,181 | 5/1968 | Oberdorfer | 252/170 |
| 3,442,631 | 5/1969 | Gluckstein | 44/68 |
| 3,585,012 | 6/1971 | Licke | 44/68 |
| 3,718,444 | 2/1973 | Hnizda | 44/66 |
| 3,883,320 | 5/1975 | Strubl | 44/68 |
| 3,926,580 | 12/1975 | Gautreaux | 44/68 |
| 3,926,581 | 12/1975 | Plonaker | 44/68 |
| 3,946,057 | 3/1976 | Reedy | 260/439 R |
| 3,948,618 | 4/1976 | Niebylski | 44/360 |
| 3,950,145 | 4/1976 | Niebylski | 44/360 |
| 3,958,955 | 5/1976 | Gautreaux | 44/68 |
| 3,976,437 | 8/1976 | Shang et al. | 44/56 |
| 3,976,438 | 8/1976 | Bay | 44/61 |
| 4,005,992 | 2/1977 | Niebylski | 44/68 |
| 4,005,993 | 2/1977 | Niebylski | 44/68 |
| 4,028,065 | 6/1977 | Sprague et al. | 44/360 |
| 4,047,900 | 9/1977 | Dorn | 44/68 |
| 4,052,171 | 10/1977 | Niebylski | 44/68 |
| 4,082,517 | 4/1978 | Niebylski | 44/68 |
| 4,139,349 | 2/1979 | Payne | 44/68 |
| 4,140,491 | 2/1979 | Allaim | 44/56 |
| 4,141,693 | 2/1979 | Feldman et al. | 44/359 |
| 4,175,927 | 11/1979 | Niebylski | 44/68 |
| 4,191,536 | 3/1980 | Niebylski | 44/68 |
| 4,207,076 | 6/1980 | Bove et al. | 44/56 |
| 4,207,077 | 6/1980 | Bove et al. | 44/56 |
| 4,207,078 | 6/1980 | Sweeney et al. | 44/56 |
| 4,209,652 | 6/1980 | Ward | 568/882 |
| 4,266,946 | 5/1981 | Niebylski | 44/68 |
| 4,300,912 | 11/1981 | Townsend | 44/56 |
| 4,302,215 | 11/1981 | Lewis | 44/71 |
| 4,334,889 | 6/1982 | Takabayski | 44/50 |
| 4,371,377 | 2/1983 | Weinberger | 44/56 |
| 4,372,752 | 2/1983 | Lamy | 44/50 |
| 4,380,455 | 4/1983 | Smith | 44/387 |
| 4,387,257 | 6/1983 | Burns | 585/14 |
| 4,392,868 | 7/1983 | Teckmeyer | 44/56 |
| 4,437,436 | 3/1984 | Graiff | 44/68 |

| | | | |
|---|---|---|---|
| 4,468,233 | 8/1984 | Bruderrech et al. | 44/56 |
| 4,518,395 | 5/1985 | Petronella | 44/53 |
| 4,600,408 | 7/1986 | Jessup et al. | 44/70 |
| 4,674,447 | 6/1987 | Davis | 44/68 |
| 4,812,146 | 3/1989 | Jessup | 44/77 |
| 4,891,049 | 1/1990 | Dillon et al. | 44/387 |
| 4,904,279 | 2/1990 | Kanne et al. | 44/387 |
| 5,004,480 | 4/1991 | Kanne et al. | 44/387 |
| 5,013,329 | 5/1991 | Bell | 44/448 |
| 5,113,803 | 5/1992 | Hollrah | 44/359 |
| 5,132,259 | 7/1992 | Curnett | 502/37 |
| 5,268,008 | 12/1993 | Kanne | 44/444 |
| 5,387,708 | 2/1995 | Molzahn | 558/277 |
| 5,391,803 | 2/1995 | King | 558/277 |

FOREIGN PATENT DOCUMENTS

| | | |
|---|---|---|
| 263843 | 10/1963 | Australia . |
| 1073207 | 3/1980 | Canada . |
| 950147 | 2/1964 | United Kingdom . |
| 1003303 | 9/1965 | United Kingdom . |

OTHER PUBLICATIONS

Alcohol Week, vol. No. 5, No. 47, Nov. 26, 1984.
"The Use of Oxinol TM and Other Alcohol Blending Components in Gasoline," by DeJovine, Gustens, et al., 1982.
"Methanol and Ethanol Fuels forModern Cars," Keller, J. L., 1979.
"Exhaust Emissions and Fuel Economy from Automobiles Using Alcohol/ Gasoline Blends Under High Altitude Conditions," David Richardson, 1978.
"Ethanol/Gasoline Blends as Automotive Fuel," Allsup and Eccleston, 1979.
"Exhaust and Evaporative Emissions from Gasohol–Type Fuels," Naman and Allsup, 1980.
"Diesel Fuel Oils," Ella Mae Shelton, 1981.
"Diesel Fuel Demand, A Challenge to Quality," George Unzelman, Ethyl Corporation (date unknown).
"Developments in Automotive Technology, Fuels, and Lubricants," Route, Amann, Gallopoulos, 1981.
"Alcohols—A Technical Assessment of Their Application as Fuels," API, Jul., 1976.
"Octane Improvement Synergism With Alcohol Mixture," Brian Davis, Walter Douthet, Suntech, Inc. (date unknown).
"Technical, Logistical and Economic Aspects of Low Methanol Blend," Liquid Fuels Trust Board, Nov., 1980.
"Methanol Blending, Report and Recommendation to the Minister of Energy," Nov. 30, 1980, Liquid Fuels Trust Board.
"Technical Aspects of Low Methanol Blends," Jun., 1980, Liquid Fuels Trust Board.
"Physical Properties of Gasoline/Alcohol Blends," Frank Cox, DOE, Sep., 1979.
"Physical Properties of GAsoline/Methanol Mixtures," Eccleston and Cox, DOE, Jan., 1977.
"Petrocoal—A Technial and Economic Overview," DeShazer and Kingsley, NPRA, 1982.
"Lead Phasedown—Major Contributor to Evolutionary Oil Industry Change," by George Unzelamn, NPRA, 1985.
"Alcohols as Motor Fuel?", Keller, James, Hydrocarbon Processing, May, 1979.
"Proceedings of Third Internation Symposium on Alcohol Fuels Technol–ogy," May 29–31, 1979, US Department of Energy, Published, Apr., 1980.
1978 Ethyl Corporation MMT application for an EPA Clean Air Act Waiver, with supporting technical articles on MMT, along with the decision of the administration.
1981 Ethyl Corporation MMT Waiver Application and Docket EN–81–15 (microfich) along with the decision of the administrator.
1971 AROC Oxinol Waiver Application and Docket En–81–10 (microfich), along with the decision of the administrator.
1984 Dupont Alcohol Waiver Application and Docket En–84–06 (micro–fich).
1982 Anafuel Petrocaol Waiver Application, Docket EN–81–8, and Waiver Decision.
1982 Synco 76 Fuel Corporation Waiver Decision of the Administrator.
1979 ARCO MTBE Waiver Decision of the Administrator.
Letter to Bill Orr from the Naitonal Petroleum Refiners Association (date unknown).
Table 4 on page 5, Engine Out HC and CO Summary, MMT: A Further Evaluation, by D. L. Lenane of Ethyl Corp., SAE 770656 (date unknown).
Niebylski's "Fuel A" 40–hour spark plug and Orr's Fuel B 80–hour spark plug from the Farmland Test, Cyclinder 3. (date unknown).
"Experimental Results Using Methanol and Methanol/Gasoline Blends as Automotive Engine Fuel," Allsup, J.R., Report #BERC/RI–76/15, Bartlesville Energy Research Center, 1977.
"Potential Corrosion of Fuel Systems by Methanol Blend," Earl, W.B., University of Canterbury, 1979.
"Combustion and Emission Characteristics of Methanol," Harrington, J.A., Pilot, R.M., Paper #750450, SAE. (date unknown).
"MMT–A Versatile Antiknock," Bailie, Michalski and Unzelman, NPRA Paper #AM–78–36. (date unknown).
Study Rates Alcohols as Octane Blending Agents, Hinkamp, James B., Oil & Gas Journal, Sep. 12, 1983.
The Consequences of MMT Removed from Unleaded Gasoline, Ethyl Corporation, 1978.
"Methanol Fuel Modification for Highway Vehicle Use —Final Project," J.L. Keller, G.M. Nakuguchi and J.C. Ware, HCP/W3683–18, DOE, Jul., 1978.
"Methanol/Gasoline Blends: Performance in Laboratory Test and in Vehicles," Crowley, Kubrick et al., SAE Paper #750419 (date unknown).
"An Evaluation of Manganese as an Anti–knock in Unleaded Gasoline," J.E. Faggen, J.D. Dailie, et al., Ethyl Corporation, SAE, Oct. 1975.
MMT—A Further Evaluation, Lenane, D.L. Ethyl Corporation, SAE, Jun., 1977.
Effect of MMT on Emissions from Production Cars, D.L. Lenane, Ethyl Corporation, SAE, Feb., 1978.

*Primary Examiner*—Jerry D. Johnson

[57] ABSTRACT

Fuel compositions comprised of well-defined proportions of cyclopentadienyl manganese tricarbonyl antiknock compounds, solvents selected from the group consisting of $C_1$ to $C_6$ aliphatic alcohols and nonleaded gasoline bases, possess improved long term hydrocarbon combustion emissions and technical enleanment characteristics. When methanol is used as the solvent it is desirable that a cosolvent selected from the group consisting of $C_2$ to $C_{12}$ aliphatic alcohols, $C_3$ to $C_{12}$ ketones and/or $C_2$ to $C_{12}$ ethers also be present in the fuel composition to assure phase stability.

52 Claims, 2 Drawing Sheets

NON LEADED FUEL COMPOSITION

The present application is a continuation of Ser. No. 07/511,896 filed Apr. 10, 1990, now abandoned which was a continuation of Ser. No. 06/770,836 filed Aug. 28, 1985, now abandoned which was a continuation-in-part of Ser. No. 06/670,556 filed Oct. 9, 1984 now abandoned.

BACKGROUND OF THE INVENTION

1. Field of the Invention

This invention relates generally to novel fuel compositions for spark ignition internal combustion engines. More particularly, it relates to a novel additive combination for "nonleaded" gasoline compositions.

2. Description of the Prior Art

The incorporation of various organo-metallic compounds as antiknock agents in fuels for high compression, spark ignited, internal combustion engines has been practiced for some time. The most common organo-metallic compound used for this purpose is tetraethyl lead ("TEL"). Generally these organo-metallic compounds have served well as antiknock agents. However, certain environmental hazards are now associated with the alkyl lead components of these compounds. This circumstance has precipitated a series of Environmental Protection Agency ("EPA") mandates aimed at completely phasing out leaded gasolines.

Many alternatives to these organo-metallic compounds also have been proposed and/or used. For example organomanganese compounds such as cyclomatic manganese tricarbonyls particularly methylcyclopentadienyl manganese tricarbonyl ("MMT"), were once accepted alternatives to TEL. However, these compounds produced another set of environmental problems. Their use tends to steadily increase the amount of unoxidized and/or partially oxidized hydrocarbons emitted from engines commonly referred to as "engine out hydrocarbons" (EOHC). Fuels containing such organomanganese compounds gradually cause the emission of substantially higher levels of hydrocarbons than are permitted under law. Aggravating the air pollution problem, such organomanganese compounds, particularly MMT, when used at concentrations greater than about 1/16 per gram manganese per gallon, are believed to be responsible for catalytic converter plugging. Accordingly, under Federal Law the use of MMT is currently banned in all unleaded gasolines.

It is well known in the art that many lower molecular weight aliphatic alcohols possess antiknock properties. They have been used as motor fuels in their own right and they have also been used as antiknock additives in both leaded and nonleaded gasolines.

As might be expected, many attempts have been made to combine tetraethyl lead, cyclomatic manganese tricarbonyls, and/or lower aliphatic alcohols with petroleum hydrocarbon products boiling within the gasoline range. Some combinations are the result of chemical compounding, while others represent noncompounded physical blends in various combinations. Certain combinations of these ingredients have been blended with or without the use of stabilizers. U.S. Pat. No. 3,030,195 (the "195 patent") well summarizes the results of prior art efforts to physically blend TEL, MMT and certain lower aliphatic alcohol antiknock agents in gasoline without the aid of stabilizing agents. For example, the 195 patent points out that when lower aliphatic alcohols and TEL type compounds are present together in petroleum hydrocarbon gasolines, the antiknock effect achieved by the combination is substantially lower than would be expected in view of their known individual antiknock efficacies. This phenomena is commonly referred to as "negative lead susceptibilities". The 195 patent teaches that a positive synergism in the antiknock properties of leaded gasoline/alcohol fuel compositions can be obtained by adding a cyclomatic manganese tricarbonyl such as MMT to leaded gasoline compositions. However, at this time the technical advantages produced by such fuel compositions are being effectively negated by the phase out of lead containing antiknock additives.

Other investigations aimed at describing the physical properties of leaded gasoline/alcohol blends have shown that n-propanol and i-butanol give smaller octane increases than methanol or ethanol in leaded gasolines/alcohol blends. The antiknock qualities of nonleaded gasoline/alcohol blends have also been investigated. These investigations also indicate that alcohols in general are considerably more effective octane improvers in blends utilizing low octane gasoline components as compared to high octane gasolines. See, for example, Cox, Frank W., PHYSICAL PROPERTIES OF GASOLINE/ALCOHOL BLENDS, Bartlesville Energy Technology Center, Bartlesville, Okla. (1979).

It is also well known that lower molecular weight aliphatic alcohols and gasoline when blended together form nonideal mixtures with respect to octane numbers. This nonideal behavior results in an additional benefit in that the actual increase in octane value of a gasoline/alcohol mixture is greater than that expected from the amount of alcohol added and the octane value of the gasoline taken separately. Consequently, those skilled in this art generally use the octane value, known as "blending octane value" or the average of research and motor octane (R+M)/2, to estimate the effect of alcohol on the gasoline base. For example, depending upon the octane values of the base gasoline, methanol/gasoline blends have been reported to be 2 to 3 Motor Octane Number and as high as 16 Research Octane Number above the reported values for the base gasoline. In any event, such finished methanol/gasoline fuels normally are 1.5 to 3 octane points (R+M)/2 higher than the base fuel itself. See for example, Eccleston, B. H. and Cox, F. W., PHYSICAL PROPERTIES OF GASOLINE/METHANOL MIXTURES, Bartlesville Energy Research Center, Bartlesville, Okla. (1977).

Notwithstanding these antiknock benefits, methanol by itself is not widely used as a gasoline additive due to the number of serious technical and legal problems associated with its use. In the technical realm, the presence of even small amounts of water can cause serious operational problems. Methanol when used by itself (and to a lesser extent ethanol) tends to phase-separate from gasoline in the presence of water and/or when exposed to cold weather conditions. This tendency to phase-separate has been a major obstacle to the use of such alcohols as octane enhancers and gasoline extenders. Further, methanol, particularly when it has phase-separated from gasoline, is known to have harmful corrosive tendencies to certain fuel delivery and engine components.

For these and other reasons, Section 211(f)(a) of the Clean Air Act, as amended (42 USC 7445), governs the usage and introduction of additives in unleaded gasolines and specifically provides that no fuel or fuel additive may be first introduced into commerce that is not "substantially similar" to any fuel or fuel additive used in the certification of any 1974 or later model year vehicle. In July 1981, EPA defined "substantially similar" to include fuels with up to 2.0 wt. percent oxygen. Ethers or alcohols (except methanol) are acceptable additives if they otherwise meet these oxygen limitations. Methanol can be used as a de-icer when used up to 0.3 volume percent or be used for this purpose up to 2.75 volume percent when introduced with an equal volume of butanol or a higher molecular weight alcohol. However, the fuel must conform to the characteristics of an unleaded gasoline as specified by ASTM D 439. This definition of "substantially similar" provides a general rule for the inclusion of oxygenates in unleaded gasolines. Methyl tertiary butyl ether (MTBE) qualifies under the general 2% oxygen rule. This is equivalent to about 11% MTBE by volume, depending on the specific gravity of the gasoline.

The Clean Air Act under Section 211(f)(4) provides that the EPA Administrator may waive the prohibition on new fuels or fuel additives. However, prior to granting a waiver the Administrator must determine if the application meets the burden of demonstrating that the new fuel or fuel additive will not cause the failure of an emission control system or an emission standards(s). Under this section of the Act, the Administrator has both denied and granted several waiver requests.

The EPA has denied all previous waiver requests involving MMT in unleaded gasoline. The EPA denied Ethyl Corporation's MMT waiver applications because Ethyl failed to demonstrate that MMT at its proposed concentration levels of 1/16, 1/32 and 1/64 gram per gallon of gasoline would not cause or ultimately cause unacceptable hydrocarbon emissions. See generally Environmental Protection Agency in RE Applications for MMT Waiver, Federal Register, Vol. 43, No. 181, Monday, Sep. 18, 1978, and Ethyl Corp; Denial of Application for Fuel Waiver; Summary of Decision, Federal Register, Vol. 46, No. 230, Tuesday, Dec. 1, 1981.

The EPA has also denied several waiver requests for alcohol additives. However, on Sep. 23, 1981, Anafuel Unlimited was granted a waiver for a proprietary fuel called "Petrocoal" (see generally the Petrocoal Waiver and Supporting Docket EN 81-8). "Petrocoal" is a mixture of methanol and certain four-carbon alcohols in unleaded gasoline in the presence of a proprietary corrosion inhibitor. The fuel can contain up to 12 volume percent methanol and up to 15% total alcohols. The ratio of methanol to four-carbon alcohols cannot exceed 6.5 to 1. The fuel must meet ASTM D 439 specifications.

The EPA granted on Nov. 16, 1981 a request by ARCO for a waiver for mixtures of methanol and gasoline-grade tertiary butyl alcohol "GTBA" (see generally the Oxinal Waiver granted in the EPA and Supporting Docket EN-81-10). ARCO markets these mixtures under the name "Oxinol". The ratio of methanol to GTBA cannot exceed 1 to 1, and the concentration of oxygen in the finished fuel cannot exceed 3.5 weight percent. The 3.5% oxygen limit translates into about 9.6% by volume. The lower the methanol content, the greater the total alcohol volume allowable. At zero methanol content, the 3.5 weight percent oxygen is equivalent to about 16 volume percent GTBA.

In 1979, EPA granted a waiver for "gasohol", which contains 10 volume percent ethanol (see generally the Gasohol Waiver). However, the general rule of 2 weight percent oxygen would limit ethanol to about 5.5 volume percent. This left an "illegal" limit between the 5.5 and 10 percent levels. In 1982, EPA interpreted the "gasohol" waiver to include any amount up to 10 volume percent anhydrous ethanol in unleaded gasoline.

The above described legal limitations also follow from the physical properties of such alcohol gasoline compositions, e.g., vapor pressure, enleanment, and evaporative emissions which can be adversely affected by the presence of lower molecular weight alcohols such as methanol and ethanol.

For example, methanol is 50 percent by weight oxygen. This leads to a potential problem known in the art as "enleanment". Fuel introduction and delivery systems (e.g., fuel injection systems, carburetors) are designed and adjusted to provide a predetermined stoichiometric amount (ratio) of air to fuel, and hence the amount of oxygen to fuel. In fuel carburetors and in cars without oxygen sensing devices this predetermined stoichiometric ratio is calculated without regard for gasolines containing oxygen. If a gasoline contains excessive concentrations of oxygenated components such as methanol, the air (oxygen) to fuel ratio is significantly changed from the predetermined ratio. Significant deviations from the predetermined ratio causes poor ignition and combustion properties of the fuel. A high air (oxygen) to fuel ratio produced in this manner will cause the engine to run lean. If an engine's air (oxygen) to fuel ratio becomes too high or lean, the engine will fail to start and/or continue to run.

In effect, enleanment sets a technical limit on the total amount of any oxygenated component such as alcohol that can be incorporated into a gasoline without making major modifications to most fuel introduction and delivery systems. Moreover, higher air (oxygen) to fuel ratios also may contribute to the production of certain environmentally harmful nitrogen oxides.

An attribute of enleanment which heretofore has not been distinguished by those skilled in the art is called "technical enleanment". "Technical enleanment" is that unexpected phenomena which exhibits symptoms of enleanment occurring when the total air (oxygen) content of the finished fuel is not stoichiometrically or chemically lean. Such behavior is very similar to enleanment and includes engine stalling, lack of power, poor combustion, difficult start-ups (especially warm start-ups) and other problems normally associated with oxygen containing fuels, including alcohol/gasoline fuels and combustion/fuel systems which are known to be chemically or stoichiometrically lean. The difference between chemical or stoichiometric enleanment and "technical enleanment" is that traditional chemical or stoichiometric enleanment can be predicted from a chemical and/or stoichiometric basis, whereas "technical enleanment" is not predictable on the same basis.

Since the EPA has exclusive jurisdiction of unleaded gasoline additives, exhaust emissions are a major concern when incorporating alcohols into unleaded gasolines. Numerous studies on this subject, including prior EPA waiver applications for alcohol additives, exist in the literature. These studies generally show that carbon monoxide emissions are reduced, and that nitrogen oxide emissions are generally unchanged. Hydrocarbon emissions from such fuels generally vary. For example Appendix B of the EPA's Waiver for "Petrocoal" showed the fuel's hydrocarbon emissions to be unchanged, see Federal Register Vol. 46, No. 192, Monday, Oct. 5, 1981, Page 48978. However, in one of the more comprehensive studies on the subject prepared under the direction of the U.S. Energy Research and Development Administration, hydrocarbon emissions increased with the introduction of methanol. Hydrocarbon emissions increased further by increasing the methanol concentrations in the base gasoline. See J. R. Allsey, EXPERIMENTAL RESULTS USING METHANOL AND METHANOL/GASOLINE BLENDS AS AUTOMOTIVE ENGINE FUEL, Bartlesville Energy Research Center, Bartlesville, Okla. (1977).

Therefore, in view of the federally mandated ban on methyl cyclopentadienyl manganese tricarbonyls (MMT), the phase-out of leaded gasolines, and in further view of the above noted technical and legal problems associated with gasoline/alcohol blends, there now exists a very pressing need to find new families of environmentally safe antiknock agents and/or learn to use known antiknock agents in ways which are technically and environmentally acceptable. Applicants believe that the latter course holds the best immediate promise.

SUMMARY OF THE INVENTION

Applicant believes that the unacceptable hydrocarbon emissions and other pollution problems associated with the use of cyclomatic manganese tricarbonyls such as MMT are directly traceable to the associative build-up of unoxidized or partially oxidized hydrocarbons and the oxide of manganese ("$Mn_30_4$"). The oxide of manganese is the oxidation product of the cyclomatic manganese tricarbonyls. Although the exact chemical mechanism of this hydrocarbon/$Mn_30_4$ build-up is not fully understood, applicant believes that it begins with the formation of a hydrocarbon gum material ("HGM") comprised chiefly of unoxidized or partially oxidized hydrocarbons and $Mn_30_4$. It is believed that once formed, the HGM tends to attract other unoxidized or partially oxidized hydrocarbons and $Mn_30_4$ which together tend to plug catalysts, foul spark plugs and form combustion chamber deposits. It is also believed, especially when the quantities of MMT are in excess of about 1/16 g manganese per gallon, that the presence of HGM causes a certain type of $Mn_30_4$ deposit in the catalytic converter system which ultimately causes it to plug.

In the first aspect of this invention, Applicant have discovered that certain beneficial chemical reaction(s) unexpectedly occur when organomanganese containing unleaded gasolines are combined with $C_1$ to $C_6$ aliphatic alcohols such that the resultant novel fuel composition can be made to meet current federal hydrocarbon emission standards of 0.41 grams per mile. This novel fuel composition can become eligible for EPA waivers of the type noted above which heretofore have been denied due to potential catalyst plugging and excessive hydrocarbon emissions. The beneficial effect of this novel fuel is achieved by the use of certain well-defined proportions of $C_1$ to $C_6$ aliphatic alcohols, and well-defined proportions of cyclopentadienyl manganese tricarbonyl antiknock agents and nonleaded gasoline bases.

In the second aspect of this invention, Applicant have further discovered that usage of the well-defined proportions of cyclopentadienyl manganese tricarbonyl antiknock agents in unleaded gasoline bases together with the well-defined proportions of $C_1$ to $C_6$ aliphatic alcohols and/or co-solvents in a manner more fully described below, unexpectedly alleviates and corrects the phenomena of "technical enleanment (T.E.)".

No blending stabilizers (other than the disclosed cosolvents needed when methanol is employed) are required when these three ingredient categories are combined in applicants' defined proportions. Cosolvents are added when methanol is used to insure the phase stability of the fuel composition.

DETAILED DESCRIPTION OF THE INVENTION

1. Defined Proportions of the Ingredients

Figure 1:
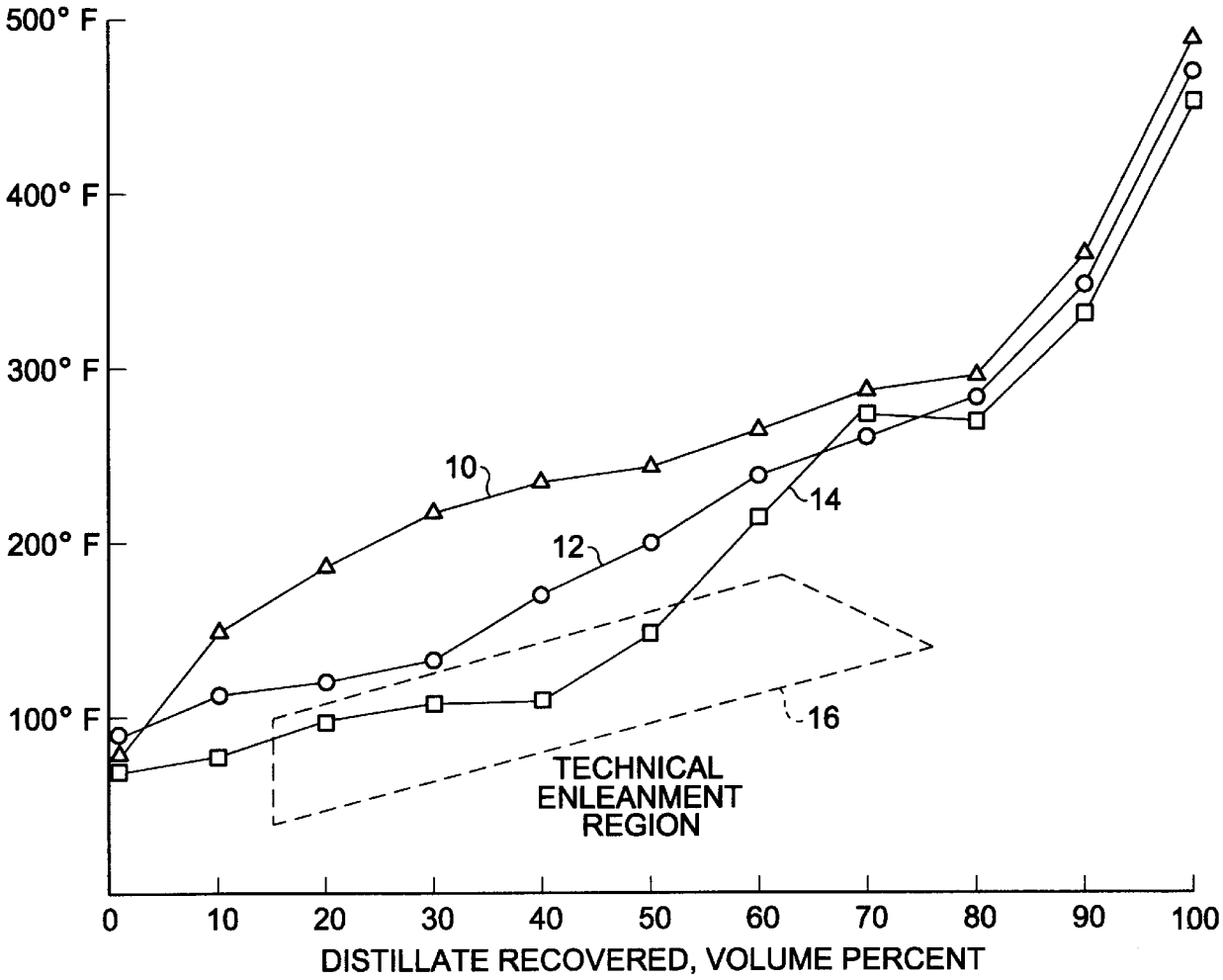
FIG. 1 graphically illustrates the concept of technical enleanment, with the vertical axis representing temperature in degrees F° and the horizonal axis representing the volume percent of distilllate recovered for various fuel blends. depicts the concept of technical enleanment.

The defined range of proportions over which the gasoline bases, the $C_1$ to $C_6$ aliphatic alcohol component, and the cyclopentadienyl manganese tricarbonyl component may be employed to reduce hydrocarbon emissions, and control technical enleanment are:

TABLE OF INGREDIENT RANGES

| | | | |
|---|---|---|---|
| Unleaded base Gasoline (Vol. %) | 95–99.9 | 92–95 | 70–92 |
| $C_1$ to $C_6$ aliphatic alcohols (vol. %) | 0.1–5.0 | 5.0–8.0 | 8.0–30.0 |
| $O_2$% by weight* | 0.05–2.4 | 0.7–3.8 | 1.2–14.2 |
| Methyl Cyclopentadienyl manganese tricarbonyl (MMT) (grams/manganese/gallon | **–1.0 | **–1 7/8 | **–2.0 |

*including cosolvents, if any.
**1/1000 gram.

Generally, within these ranges, the higher the total concentration of the lower molecular weight alcohols (particularly methanol, ethanol and propanol in order of their preference) the higher the preferred concentrations of manganese. With manganese concentrations of 1/8 gram in the fuel composition the beneficial EOHC effect generally does not begin to occur until approximately 2% by volume of the $C_1$ to $C_6$ alcohol component is introduced into the fuel composition.

It is recommended in normal cases that when methanol is used as the sole aliphatic alcohol without the benefit of any cosolvent(s) it should be limited to a concentration of about 5 volume percent or less of the fuel composition.

However, in most cases when methanol is employed in concentrations ranging from about 1 to about 24 volume percent of the fuel composition, cosolvent(s) selected from the group consisting of $C_2$ to $C_{12}$ aliphatic alcohols, $C_3$ to $C_{12}$ ketones and/or $C_2$ to $C_{12}$ ethers in concentrations from about 1 to about 20 volume percent should also be employed. The combined methanol and cosolvent concentration should, however, not exceed 30 volume percent of the entire fuel composition. When the cosolvent alcohol(s) is selected from the group consisting of $C_2$ to $C_8$ aliphatic alcohols, the preferred aliphatic alcohol(s) are saturated aliphatic alcohol(s).

In the practice of this invention, one or more $C_1$ to $C_6$ aliphatic alcohols, preferably, $C_1$ to $C_6$ saturated aliphatic alcohols, must be employed in the fuel composition. The alcohol component may be any individual alcohol or any combination thereof. Mixed alcohol combinations may be desirable for enhancing blending octane values and controlling RVP increases. It is contemplated in the practice of this invention that mixed alcohols produced from the modification of known methanol or other alcohol catalysts, use of alkali metal oxide catalysts, use of rhodium catalysts, isosynthesis using alkalized $ThO_2$ catalysts, modified lurgi catalysts, and/or produced from certain isomerization/ dehydrogenation processes, olefinic/hydration processes, "OXO" processes and the like, are acceptable.

Alcohol mixtures, generally having methanol, ethanol, propanols, butanols, pentanols and hexanols in the composition; which by weight percent of the composition decline as the individual molecular weight of the alcohol increases, are desirable. An example of a mixed alcohol composition wherein the lower molecular weight alcohols have a higher relative proportion of the composition by volume percent than do the higher molecular alcohols include: methanol at approximately 50 weight percent of the alcohol component, ethanol at approximately 25 weight percent, propanols at approximately 13 weight percent, butanols at approximately 6 weight percent, pentanols at approximately 3 weight percent, with hexanols and other higher alcohols generally representing the balance of the alcohol component.

Another example of a desirable alcohol mixture would include a composition wherein the higher molecular weight alcohols have higher relative proportions by volume percent of the composition than do the lower molecular weight alcohols. Still another example would include a mixed alcohol composition wherein similar proportions of each alcohol exist by volume percent in the composition. Mixed alcohol compositions generally include methanol to higher alcohol ratios generally varying from about 4:1 to 1:4 weight percent of the alcohol compositions. Those other combinations of alcohol mixtures which positively effect RVP, octane, distillation characteristics, end boiling point temperatures, and/or emissions are particularly desirable.

Suitable alcohols for use include methanol, ethanol, N-propanol, isopropanol, N-butanol, secondary-butanol, isobutanol, tertiary butanol, pentanols, hexanols and the like. As noted in the Table of Ingredient Ranges, aliphatic alcohols in ranges from up to about 30.0% by volume with about up to 14.2% oxygen by weight give good hydrocarbon emission results when used in unleaded gasolines. One percent to five percent oxygen by weight in the fuel composition are, however, more preferred. The composition should have at least 0.001 grams manganese and generally no more than 2.0 grams manganese of a cyclomatic manganese tricarbonyl compound per gallon. Preferably, the alcohol employed should be anhydrous, but alcohols containing small amounts of water can also be used. Within the preferred concentration range most of the $C_1$ to $C_6$ aliphatic alcohols are completely miscible with petroleum hydrocarbons and it is preferred that such alcohols be used in amounts within their solubility limits. However, if desirable, an amount of alcohol in excess of its solubility can be incorporated in the fuel by such means, as for example, by use of mutual solvents.

Desirable individual alcohol compositions would contain up to about 20 volume percent methanol, or up to about 25 volume percent ethanol, or up to about 25 volume percent isopropanol, or up to about 25 volume percent normal propanol, or up to about 30 volume percent tertiary butanol, or up to about 30 volume percent secondary butanol, or up to about 30 volume percent isobutanol, or up to about 30 volume percent normal butanol, or up to about 30 volume percent pentanols, or up to about 30 volume percent hexanols, together with MMT as the cyclopentadienyl manganese in a concentration of about 0.001 grams to 2.0 gram of manganese per gallon of fuel composition. A more preferred manganese concentration is from about 1/32 to about 1/8 gram of manganese per gallon of fuel composition.

A desirable fuel composition contains methanol from about 1 to about 15 volume percent of the composition, $C_2$ to $C_8$ aliphatic alcohols in concentrations from about 1 to about 15 volume percent of the composition and a preferred MMT concentration from about 0.001 to about 1/4 gram of manganese per gallon of fuel composition and a more preferred MMT concentration from about 1/64 to 1/8 gram per gallon.

A preferred fuel composition contains methanol from about 1 percent to about 9 volume percent of the composition, $C_2$ to $C_8$ aliphatic alcohols in concentrations from about 1 to about 10 volume percent of the composition, a MMT concentration from about 0.001 to about 1/4 gram manganese per gallon of fuel composition and a more preferred MMT concentration from about 1/64 to 1/8 gram per gallons.

A more preferred fuel composition contains methanol from about 2 to about 6 volume percent with $C_3$ to $C_8$ aliphatic alcohols in concentration from about 1 percent to about 10 volume percent of the composition and a MMT concentration from about 0.001 to about 1/4 gram manganese per gallon of fuel composition and a more preferred MMT concentration from about 1/64 to 1/8 gram per gallon.

An even more preferred fuel composition would contain methanol from about 2 to 6 volume percent with $C_4$ to $C_6$ saturated aliphatic alcohols in concentrations from about 1 percent to about 10 volume percent of the composition, particularly those having boiling points higher than tertiary butanol and a MMT concentration from about 0.001 to about 1/4 gram manganese per gallon of fuel composition and a more preferred MMT concentration from about 1/64 to 1/8 gram per gallon.

2. Correcting Technical Enleanment

The second aspect of this invention involves controlling T.E. although the actual cause of "technical enleanment " ("T.E.") is not fully understood, Applicant has discovered that methanol and/or ethanol gasoline blends are particularly susceptible to technical enleanment T.E. symptoms are aggravated when the base fuel is highly volatile, low aromatic, high paraffin, and/or has a high mid-range boiling temperature. Applicant has discovered that technical enleanment symptoms of oxygenated fuels can be substantially alleviated or even corrected by the use of the above noted proportions of base gasolines, cyclopentadienyl manganese tricarbonyl antiknock compounds and the addition of aliphatic alcohols and/or cosolvent(s) in the manner described below.

An unexpected synergism has been discovered when both MMT and the $C_1$ to $C_6$ aliphatic alcohols, especially the higher boiling point alcohols, are used jointly to alleviate and correct the symptoms of T.E. Applicants are not entirely sure of MMT chemical mechanism. However, it is believed that MMT when in combination with the aliphatic alcohols tends to act as some sort of combustion catalyst improving the fuels ignition and combustion properties in such a manner as to alleviate T.E. symptoms.

Another aspect which Applicant believes influences technical enleanment is the distillative nature of alcohol/gasoline fuels themselves. Lower boiling point oxygenates, including alcohols tend to form azetropes with the lower boiling gasoline components and depress the temperatures at which the initial and middle fuel fractions distill. The applicant believes that in certain cases this depression or displacement becomes so aggravated as to become a principal factor in T.E.

FIG. 1 illustrates the improved technical enleanment aspects achieved by this invention. Referring now to FIG. 1, line 10 represents the volume percent of distillate recovered as temperature increases for a base nonleaded fuel. Line 12 represents the volume percent of distillate recovered as temperature increases for a base nonleaded fuel with 6% methanol and 4% ethanol by volume percent (4.4% $O_2$ by weight), which may be referred to herein as "uncorrected fuel". Line 14 represents the volume percent of distillate recovered as temperature increases for a base nonleaded fuel with ½ gram of MMT/gallon, 6% methanol and 6% ethanol by volume percent (4.3% $O_2$ by weight), which may be referred to herein as "corrected fuel". Specifically, the tendency of the methanol and/or ethanol gasoline blends of this invention to fall into the region 16 "TECHNICAL ENLEANMENT REGION". FIG. 1 also shows the distillation curve of a base gasoline (the "Base Fuel") with a high mid-range boiling point. It also shows the base gasoline in combination with a 6 volume percent methanol and 4 volume percent ethanol mixture, the "Uncorrected Fuel". Note, that the Uncorrected Fuel mixture having an oxygen content of approximately 4.4 percent by weight intrudes into the TECHNICAL ENLEANMENT REGION due to the aggravated displacement of the lower and mid-range areas of the distillation curve. This intrusion is typical of many methanol and/or ethanol gasoline mixtures. FIG. 1 illustrates the effect of the "Corrected Fuel" by having an oxygen content of approximately 4.3 percent by weight and prepared by adding an ⅛ gram manganese of MMT and changing the cosolvent from 4 volume percent ethanol to 6 volume percent normal butanol. Note that the Corrected Fuel's distillation curve is above the TECHNICAL ENLEANMENT REGION. This example is illustrative of the improved technical enleanment characteristics of oxygen containing fuel compositions of the second of aspect of this invention. Naturally, the various compositions disclosed in this invention do not possess exactly identical effectiveness, and the most advantageous concentration for each such compound will depend to a large extent upon the particular alcohol or cosolvent used and will also depend to some extent upon the composition of the base gasoline itself.

By correcting the aggravated displacement in the distillation curve as presented in FIG. 1 with the inclusion of MMT and the higher boiling point alcohols (cosolvents) in accordance with the Applicant's described construction, Applicant has discovered a control for T.E. The combined usage of MMT, $C_1$–$C_6$ alcohols or cosolvents, exhibits a particularly ameleorative synergism effectively controlling T.E. symptoms, when constructed to have a distillation fraction above the T.E. region of FIG. 1.

This departure from the prior art understanding of enleanment behavior is important to the whole enleanment issue. This is due principally to the fact that certain oxygenates, such as methanol and/or ethanol mixtures normally are more likely to distill out of the gasoline system together with other lower boiling point gasoline substituents where azetropes are formed prior to the distillation of the other components of the gasoline. The early distillation of these oxygenated components means that the oxygen in the fuel is being distilled off at lower temperatures in the initial and/or middle fractions of the gasoline and not over the fuels entire volatility range which often results in poor combustion and symptoms of enleanment.

With the second aspect of Applicant invention, Applicants can effectively improve combustion efficiency and spread the volatility of oxygenated mixtures to match the volatility of the hydrocarbons; thereby correcting technical enleanment and permitting greater concentrations of total oxygen to be present in the fuel mixture than heretofore would have been considered practical to those skilled in the art. This represents a significant departure from the prior art. In view of the prior art literature this is quite unexpected and novel.

3. Reduction of Engine Out Hydrocarbons (EOHC)

Applicants have discovered that those MMT concentrations that heretofore have been considered excessive for reasons associated with unacceptable EOHC emissions and possible catalyst plugging, when combined with the aliphatic alcohols, and unleaded gasoline bases in accordance with Applicant's noted proportions and construction, tend to prevent unacceptable EOHC emissions and prevent catalyst plugging. In view of the extensive prior art literature on the subject, this result is also quite unexpected.

Figure 2:
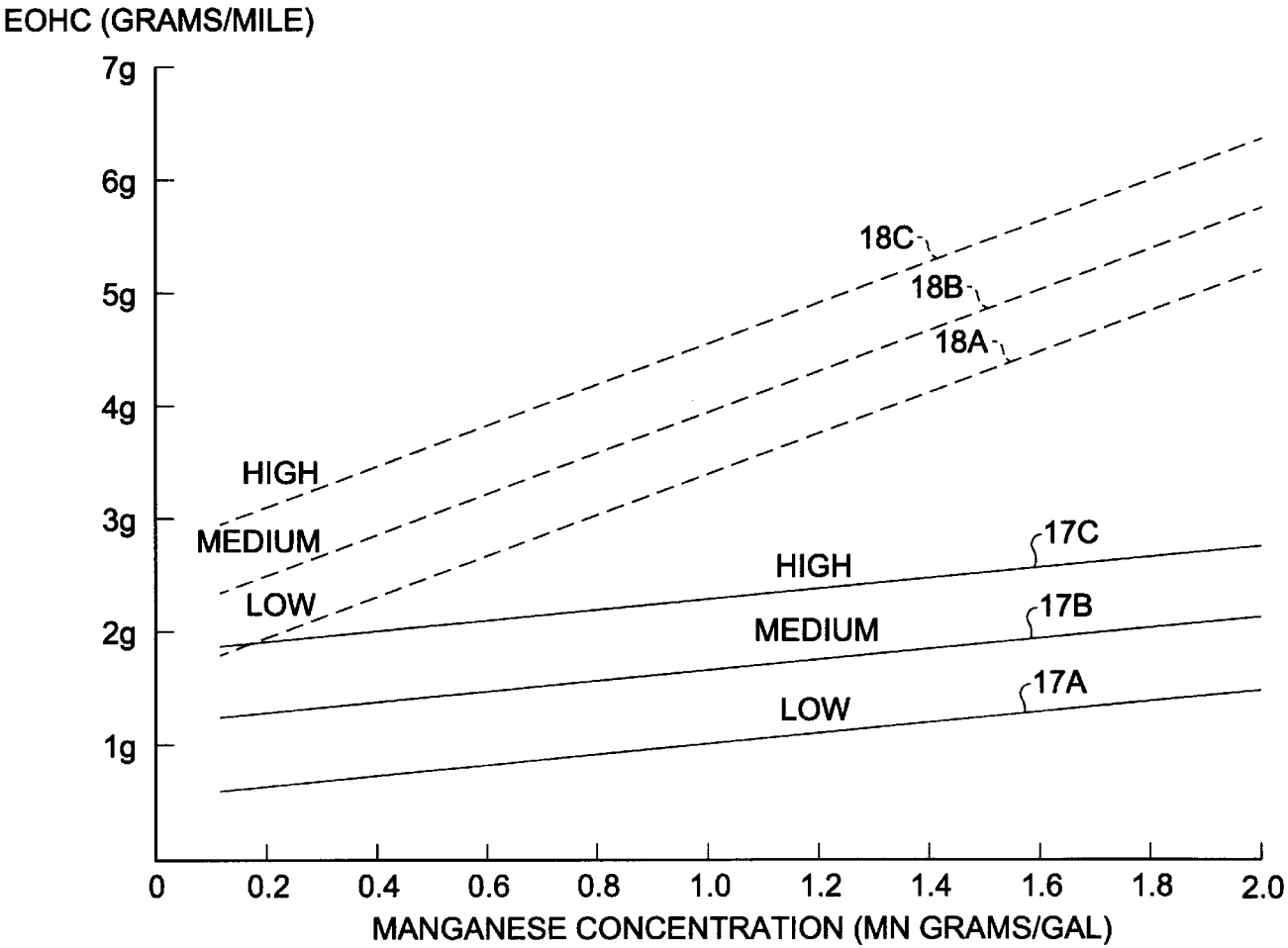
FIG. 2 graphically compares hydroarbon emission ranges for pre 1980 cars at 5000 miles using various fuel blends, with the vertical axis representing engine out hydrocarbon emissions (EOHC) (g/mi) and the horizontal axis representing manganese concentration in grams per gallon (Mn g/gal.) for various fuel blends.

The beneficial hydrocarbon emission effects are best illustrated in FIG. 2. FIG. 2 illustrates the 17A, 17B and 17C low, medium and high ranges, respectively, of hydrocarbon emissions improvement expected at 5,000 miles using the defined proportions of $C_1$ to $C_6$ aliphatic alcohols (cosolvents), MMT and unleaded base gasolines (the "Corrected Fuels"), i.e., nonleaded fuels containing MMT with C1 to C6 aliphatic alcohols, including co-solvents, in accordance with applicant's defined proportions, over 18 A. 18B and 18C low, medium and hi ranges, respectively, of fuels just employing MMT concentrations without the benefit of $C_1$ to $C_6$ aliphatic alcohols (the "Uncorrected Fuels"). The 5,000 mile mark reflects the critical point where the initial assent in hydrocarbon emissions is typically experienced in MMT containing nonleaded fuels. The effect of methanol and its associated cosolvents, including ethers and ketones, are incorporated in FIG. 2. FIG. 2 illustrates the significant differences in the hydrocarbon emission behavior of pre-1980 standard model cars (manufactured for under 1.5 grams of hydrocarbon emission per mile standards) using the Uncorrected Fuel and the Corrected Fuel formulated in accordance with Applicant's invention.

The methyl cyclomatic manganese tricarbonyls used in our compositions can contain such homologes or substituents as, for example, alkenyl, aralkyl, aralkenyl, cycloalkyi, cycloalkenyl, aryl and alkenyl groups. Illustrative, but nonlimiting examples of such substituted and unsubstituted cyclomatic manganese tricarbonyl antiknock compounds are: cyclopentadienyl manganese tricarbonyl; methylcyclopentadienyl manganese benzyleyelopentadienyl manganese tricarbonyl; 1,2-dipropyl 3-cyclohexylcyclopentadienyl manganese tricarbonyl; 1,2-diphenylcyclopentadienyl manganese tricarbonyl; 3-propenylienyl manganese tricarbonyl; 2-tolyindenyl manganese tricarbonyl; fluorenyl manganese tricarbonyl; 2,3,4,7-propyfluorenyl manganese tricarbonyl; 3-naphthylfluorenyl manganese tricarbonyl; 4,5,6,7-tetrahydroindenyl manganese tricarbonyl; 3-ethenyl-4,7-dihydroindenyl manganese tricarbonyl; 2-ethyl 3(a-phenylethenyl) 4,5,6,7 tetrahydroindenyl manganese tricarbonyl; 3-(a-cyclohexylethenyl); 4,7-dihydroindenyl manganese tricarbonyl; 1,2,3,4,5,6,7,8-octahydrofluorenyl manganese tricarbonyl and the like. Mixtures of such compounds can also be used. The above compounds can generally be prepared by methods which are known in the art. Representative preparative methods are described, for example, in U.S. Pat. Nos. 2,818,416 and 2,818,417.

Since the oxidation product of the above methyl cyclomatic manganese tricarbonyls, i.e., $Mn_3O_4$, plays a leading role in HGM build-up, it is desirable to use as little of these methyl cyclomatic manganese tricarbonyl compounds as is necessary in order to maximize the HGM inhibition benefits of the invention. As seen in the Table of Ingredient Concentrations, concentrations of the methyl cyclomatic manganese tricarbonyl compound concentrations (expressed as grams of manganese metal per gallon of the resulting fuel composition) as low as 0.001 gram per gallon may be used. However, concentrations up to and including 2.0 grams manganese per gallon can be employed, but are less preferred. On occasion, amounts above the recited range can also be employed, but such concentrations tend to be less satisfactory.

In terms of economic octane benefits, concentrations in the range of from about 0.001 to about 2.0 grams manganese per gallon give good results, concentrations from about 0.001 gram to ½ gram give better results, and concentrations from about 1/64–⅛ gram/gallon give excellent results and are more preferred. This invention also contemplates the use of other additives, such as multipurpose additives. Nonlimiting examples include scavengers, made necessary or desirable to maintain fuel system cleanliness and control exhaust emissions due to the presence of the organo-manganese compound in the fuel.

4. Using Cosolvents

When methanol is used as the aliphatic alcohol of choice, it is desirable that a cosolvent should also be employed to insure phase stability of the fuel composition to the extent that the fuel composition containing methanol and approximately 500 parts per million water will not phase separate at 15° F., or the lowest temperature to which the fuel composition will be exposed. Generally speaking the methanol to cosolvent ratio should not exceed about 5 parts methanol to 1 part cosolvent depending upon the nature of the base fuel and the cosolvent(s) used.

The cosolvent(s) can be selected from the group consisting of $C_2$ to $C_{12}$ aliphatic alcohols, $C_3$ to $C_{12}$ ketones and/or $C_2$ to $C_{12}$ ethers. Within the scope of this invention it is contemplated that these cosolvents may also be used with any $C_1$–$C_6$ aliphatic alcohol, especially in cases where corrosion, phase stability or vapor pressure become an issue. It is also within the scope and teaching of this invention to employ one or more alcohols, ketones or ethers as cosolvents or any one, two or all three cosolvents classes of this invention simultaneously.

It is further contemplated, within the scope of this invention, in cases where vapor pressure or evaporative emissions are a concern, especially when $C_1$ to $C_3$ molecular weight alcohols are used individually or in combination, to employ $C_2$ to $C_7$ ethers individually or in combination with each other with or without other cosolvents.

It is also within the scope and practice of this invention to use mixed cosolvents, including mixed alcohols, ethers and/or ketones as cosolvents. It has been found that mixed cosolvent alcohols particularly those in the $C_2$ to $C_8$ range have an ameleorative effect on both RVP and octane blending values.

In accordance with the discussion of cosolvents within this invention with regard to phase stability, the preferred cosolvent class rankings would be alcohols first, ketones second, and ethers last. Also, the higher the average boiling point of the cosolvents employed within a particular class, up to a $C_8$ cosolvent, the greater the preference. With cosolvents greater than $C_8$ the reference is reversed so that a $C_9$ cosolvent would be preferred over a $C_{10}$ cosolvent and so forth.

Within the sub-categories of the particular cosolvent class, after preference is given to the alcohol, ketone and ether ranking, and after preference is given to the average boiling point characteristics, then preference would be given the branched chain molecules over straight or cyclical chained molecules.

The alcohol cosolvents will have from two to twelve carbon atoms. The preferred cosolvent alcohols are saturates having high water tolerances and high boiling points. Representative alcohol cosolvents include ethanol, isopropanol, n-propanol, tertiary butanol, 2-butanol, isobutanol, n-butanol, pentanols, amyl alcohol, cyclohexanol, 2-ethylhexanol, furfuryl alcohol, iso amyl alcohol, methyl amyl alcohol, tetrahydrofurfuryl alcohol, hexanols, cyclohexanols, furons, septanols, octanols and the like. The alcohol cosolvents, in reverse order of their preference, are propanols, butanols, pentanols, hexanols and the other higher boiling point alcohols. The more preferred alcohol cosolvents include isobutanol, n-butanol, pentanol and the other higher boiling point alcohols.

The ketones used as cosolvents in fuel compositions taught herein will have from three to about twelve carbon atoms. Lower alkenyl ketones are, however, slightly preferred. Representative lower alkenyl ketones would include diethyl ketone, methyl ethyl ketone, cyclohexanone, cyclopentanone, methyl isobutyl ketone, ethyl butyl ketone, butyl isobutyl ketone and ethyl propyl ketone and the like. Other ketones include acetone, diacetone alcohol, diisobutyl ketone, isophorone, methyl amyl ketone, methyl isamyl ketone, methyl propyl ketone and the like. A representative cyclic ketone would be ethyl phenyl ketone.

Representative ethers which can be used as cosolvents in fuel compositions taught herein will have from 2 to about 12 carbon atoms and would include the preferred methyl alkyl t-butyl ethers such as methyl tert-butyl ether, ethyl tertiary butyl ether, also preferred tertiary amyl methyl ether, dialkyl ether, isopropyl ether, di methyl ether, diisopropyl ether, diethyl ether, ethyl n-butyl ether, ethylilenedimethyl ether, butyl ether, and ethylene glycol dibutyl ether and the like. The representative straight ethers which can be used in the fuel blends of this invention would include straight chain ethers such as those presented above, as well as cyclic ethers wherein the ether's oxygen molecule is in a ring with carbon atoms. For example, 4,4-dimethyl-1,3-dioxane, tetrahydrofurans, such as, for example, 2-methyltetrahydrofuran, 2-ethyltetrahydrofuran, and 3-methyletetrahydrofuran may also find use in the present invention. The most preferred ether would be a branch chained ether. In order to be most advantageously employed, the above ethers should also be readily soluble, either directly or indirectly in the gasoline.

Generally, the preferred methanol/cosolvent ratio will range from 0.5 to 3 parts methanol to 1 part cosolvent. Ratios from about 3 to 5 parts methanol to 1 part cosolvent are also preferred in certain circumstances. The ratio of methanol to cosolvent can exceed 5 to 1 or be less than 0.5 to 1. However methanol/cosolvent ratios outside these ranges are normally less desirable unless vapor pressure or technical enleanment are issues in the fuel formulation. The methanol to cosolvent ratios will generally be higher when a higher boiling point aliphatic alcohol up to C8 is the cosolvent and lowest when ethanol is the cosolvent. In the same sense methanol to cosolvent ratios are higher with alcohols, than they are with ketones, than they are with ethers. That is to say, when a comparable higher boiling point or molecular weight alcohol, ketone or ether is compared, the highest ratio (within the general range of 3 to 5 parts methanol to 1 part cosolvent) is permissible when the cosolvent is an alcohol, the second highest ratio when the cosolvent is an alcohol, the second highest ratio when the cosolvent is the ketone and the lowest ratio when the cosolvent is an ether.

For example, in comparing normal-butanol, $CH_3$ $(CH_2)_2$ $CH_2OH$; diethyl ether, $C_2H_5)_2O$; and methyl ethyl ketone $CH_3CO$ $CH_2$ $CH_3$; the preferred ratios might be 3 to 5 parts methanol to 1 part N-butanol, 1 to 2 parts methanol to 1 part methyl ethyl ketone, and 1 part methanol to 2 to 3 parts diethyl ether. Within each of these cosolvent groups, the methanol-cosolvent ratios should be at their highest when higher molecular weight molecules (e.g., $C_4$–$C_{12}$) are used.

It is also within the scope and practice of this invention to utilize individual and/or different molecular weight cosolvent mixtures, higher alcohol mixtures (especially $C_4$–$C_{12}$ in varying combinations and concentration) together with aromatic hydrocarbons as a means of controlling RVP and technical enleanment.

5. Formulating the $C_1$–$C_6$ Aliphatic Alcohol and/or Cosolvent Component

In formulating the desired alcohol or cosolvent components and determining the preferred ratio of methanol to cosolvent(s) the following factors should be taken into consideration:

(1) The base gasoline composition.

(2) The distribution system which the finished fuel will be exposed to.

(3) The average age of the vehicular population consuming the fuel.

(4) The fuel's propensity towards technical enleanment.

(5) The fuel's effect on EOHC.

Generally the more desirable the base fuel composition as described hereafter, the less restrictive the formulation and construction of the $C_1$ to $C_6$ aliphatic alcohol or cosolvent component. The more desirable the base gasoline, the lower can be the average boiling point of the alcohol or cosolvent component. The more desirable the base gasoline the greater the permissible percentage oxygen by weight that can be contained in the finished fuel. For example, the more desirable the base gasoline the greater the flexibility in reducing or increasing the total percent alcohol or cosolvent by volume in the finished fuel.

For example, the higher the aromatic content of the base gasoline the higher the permissible methanol to cosolvent ratio, and the lower the required average boiling point of the alcohol or cosolvent component. Inversely, a less desirable base gasoline with lower percentages of aromatic components generally will require a lower methanol to cosolvent ratio and a higher average boiling point alcohol or cosolvent component. This same low aromatic gasoline will limit the flexibility of reducing or increasing the total volume of the alcohol component. It is likely that the alcohol component as a percent of volume would be easier to increase then it would be to decrease.

As discussed above azetropic relationships aggravate the alcohol or cosolvent component configurations as well. Particular attention must be given to the characteristics of technical enleanment. Generally in gasolines with higher mid-range volatility and/or higher paraffinic content, the methanol to cosolvent ratios are lower, sometimes less than 1. In these cases the required average boiling point of the alcohol (cosolvent) component is normally higher, and the flexibility of either increasing or reducing the total alcohol or cosolvent component is restricted. The permissible oxygen content is normally reduced and in some severe cases it should not exceed 2.5% by weight. In these base gasolines it is important to construct the alcohol or cosolvent component so as to prevent any significant displacement of the lower and particularly the mid-range gasoline fractions during distillation. It is desirable to construct the alcohols or cosolvent's volatility (distillation) to match the hydrocarbons volatility as closely as possible to cover the largest portion of the distillation curve.

In addition to considering the base gasoline to which the alcohol or cosolvent component is added, consideration must also be given to the fuel distribution system to which the finished fuel will be exposed. The greater the likelihood of significant exposure to moisture, temperature variations and cold weather conditions, the more restrictive will be the alcohol or cosolvent component construction and the higher should be the total alcohol percent volume and the lower the alcohol cosolvent ratio which is contained in the fuel.

For example, a methanol to cosolvent ratio of 3 to 1 using isopropanol as the cosolvent, together with the alcohols representing 7 percent by volume of the fuel, would normally be acceptable if the fuel were to be distributed in a dry system averaging 60° F. However, if it were anticipated that the fuel would be exposed to 20° F. temperatures, or to greater concentrations of moisture or water, then certain adjustments would have to be made. One or more of the following adjustments would be required:

(a) The methanol to cosolvent ratios would be reduced to 2 to 1, or 1 to 1, increasing the average weight of the combined alcohol (cosolvents) component.

(b) The cosolvent would be changed from isopropanol to a butanol or higher boiling point alcohols.

(c) The volume of alcohols (cosolvents) would be increased from 7 percent to 12 percent.

The age of the vehicular population which consumes the finished fuel also impacts the amount of oxygen which may be contained in the fuel. In the case of older automobiles the finished fuel may contain upwards to 5–7 percent total oxygen by weight. Those newer automobiles using 3-way catalysts which require more stringent air fuel ratios are limited to generally 4–5 percent total oxygen by weight. New vehicles containing oxygen sensing devices may use fuels containing upwards of 7 percent oxygen by weight. With the anticipated improvements of oxygen sensing devices in 1985 and future model years, the oxygen content of the finished fuel could approach 12 percent or more by weight.

In an effort to minimize the effect of EOHC and increase the anti-knock concentrations of MMT one should employ the maximum concentrations possible of $C_1$ to $C_3$ alcohols. The highest preference is given to methanol, the second to ethanol and the third to propanol.

6. Unleaded Base Gasoline Composition

The nonleaded or unleaded gasoline bases in Applicants' fuel composition are conventional motor fuel distillates boiling in the general range of about 70° to 480° F. They include substantially all grades of unleaded gasoline presently being employed in spark ignition internal combustion engines. Generally they contain both straight runs and cracked stock, with or without alkylated hydrocarbons, reformed hydrocarbons and the like. Such gasolines can be prepared from saturated hydrocarbons, e.g., straight stocks, alkylation products and the like, with detergents, antioxidants, dispersants, metal deactivators, rust inhibitors, multi-functional additives, demulsifiers, fluidizer oils, anti-icing, combustion catalysts, corrosion inhibitors, emulsifiers, surfactants, solvents or other similar and known additives. It is contemplated that in certain circumstances these additives may be included in concentrations above normal levels.

Generally, the base gasoline will be a blend of stocks obtained from several refinery processes. The final blend may also contain hydrocarbons made by other procedures such as alkylates made by the reaction of $C_4$ olefins and butanes using an acid catalyst such as sulfuric acid or hydrofluoric acid, and aromatics made from a reformer.

The olefins are generally formed by using such procedures as thermal cracking and catalytic cracking. Deyhydrogenation of paraffins to olefins can supplement the gaseous olefins occurring in the refinery to produce feed material for either polymerization or alkylation processes. The saturated gasoline components comprise paraffins and naphthenates. These saturates are obtained from: (1) virgin gasoline by distillation (straight run gasoline), (2) alkylation processes (alkylates), and (3) isomerization procedures (conversion of normal paraffins to branched chain paraffins of greater octane quality). Saturated gasoline components also occur in so-called natural gasolines. In addition to the foregoing, thermally cracked stocks, catalytically cracked stocks and catalytic reformated contain saturated components. Preferred gasoline bases are those having an octane rating of (R+M)/2 ranging from 78–95. It is desirable to blend the gasoline base so that the minimum aromatic content is no less than 15% and preferably greater than 20%. The gasoline base should have an olefinic content ranging from 1% to 30%, and a saturate hydrocarbon content ranging from about 40 to 80 volume percent.

The motor gasoline bases used in formulating the fuel blends of this invention generally have initial boiling points ranging from about 70° F. to about 115° F. and final boiling points ranging from about 380° F. to about 480° F. as measured by the standard ASTM distillation procedure (ASTM D-86). Intermediate gasoline fractions boil away at temperatures within these extremes.

Table 1 illustrates the hydrocarbon-type makeup of a number of preferred fuels which can be used in this invention.

TABLE I

| Hydrocarbon Blends of Preferred Base Fuels--Volume Percentage | | | |
|---|---|---|---|
| Fuel | Aromatics | Olefins | Saturates |
| A | 35.0 | 12.0 | 73.0 |
| B | 40.0 | 11.5 | 48.5 |
| C | 20.0 | 22.5 | 57.5 |
| D | 33.5 | 10.0 | 55.5 |
| E | 36.5 | 5.0 | 58.5 |
| F | 43.5 | 21.5 | 35.0 |
| G | 49.5 | 2.5 | 48.0 |

In terms of phase stability and water tolerance, desirable base gasoline compositions would include as many aromatics with $C_8$ or lower carbon molecules as possible in the circumstances. The ranking or aromatics in order of their preference would be: benzene, toluene, m-xylene, ethylbenzene, o-xylene, isoproplybenzene, N-propybenzene and the like. After aromatics the next preferred gasoline component in terms of phase stability would be olefins. The ranking of preferred olefins in order of their preference would be; 2-methyl-2-butene, 2 methyl-1 butene, 1 pentene, and the like. However, from the standpoint of minimizing the high reactivity of olefins and their smog contributing tendencies, olefinic content must be closely watched. After olefins the least preferred gasoline component in terms of phase stability would be paraffins. The ranking of preferred paraffins in order of their preference would be; cyclopentane, N-pentane, 2,3 dimethylbutane, isohexane, 3-methylpentane and the like.

In terms of phase stability, aromatics are generally preferred over olefins and olefins are preferred over paraffins. Within each specific class the lower molecular weight components are preferred over the higher molecular weight components.

It is also desirable to utilize base gasolines having a low sulfur content as the oxides of sulfur tend to contribute to the irritating and choking characteristics of smog and other forms of atmospheric pollution. To the extent it is economically feasible, the base gasolines should contain not more than about 0.1 weight percent of sulfur in the form of conventional sulfur-containing impurities. Fuels in which the sulfur content is no more than about 0.02 weight percent are especially preferred for use in this invention.

The gasoline bases of this invention can also contain other high octane organic components. Nonlimiting examples include phenols (e.g., P-cresal, 2,4 xylenal, 3-methoxyphenal), esters (e.g., isopropyl acetate, ethyl acrylate) oxides (e.g., 2-methylfuran), ketones (e.g., acetone, cyclopentanone), alcohols (furon, furfuryl), ethers (e.g., MTBE, TAME, dimethyl, diisopropyl), aldehydes and the like. See generally "Are There Substitutions For Lead Anti-Knocks?", Unzelman, G. H., Forster, E. J., and Burns, A. M., 36th Refining Mid-Year meeting, American Petroleum Institute, San Francisco, Calif., May 14, 1971.

The gasoline bases which this invention employs should be lead-free or substantially lead-free. However, the gasoline may contain antiknock quantities of other agents such as cyclopentadienyl nickel nitrosyl, N-methyl aniline, and the like. Antiknock promoters such as 2.4 pentanedione may also be included. On certain occasions it will be desirable for the gasoline to contain supplemental valve and valve seat recession protectants. Nonlimiting examples include; boron oxides, bismuth oxides, ceramic bonded $CaF_2$, iron phosphate, tricresylphosphate, phosphorus and sodium based additives and the like. The fuel may further contain antioxidants such as 2,6 di-tert-butylephenol, 2,6-di-tert-buyl-p-cresol, phenylenediamines such as N-N$^1$-di-sec-butyl-p-pheylenediamine, N-isopropylphenylenediamine, and the like. Likewise, the gasoline may contain dyes, metal deactivators, or other additives recognized to serve some useful purpose. The descriptive characteristics of one common base gasoline is given as example 2. Obviously many other standard and specialized gasolines can be used in Applicants' fuel blend.

| CHARACTERISTICS OF BASE GASOLINE | |
|---|---|
| Reid Vapor Pressure, psi | 7.2 |
| API Gravity @ 60 F. | 64.4 |
| ASTM Distillation Vol % Evaporate | Temp., F. |
| IBP | 86* |
| 5 | 115 |
| 10 | 132 |
| 15 | 145 |
| 20 | 157 |
| 30 | 178 |
| 40 | 197 |
| 50 | 213 |
| 60 | 229 |
| 70 | 250 |
| 80 | 286 |
| 90 | 353 |

-continued

| CHARACTERISTICS OF BASE GASOLINE | |
|---|---|
| 95 | 391 |
| EP | 428 |
| Lead Content, g/gal | 0.005 (or less and preferably none) |
| Sulfur Content, wt % | 0.04 |
| Research Octane Number | 91.5 |
| Motor Octane Number | 83.9 |
| **Component** | **Vol.** |
| Paraffins | 59.03 |
| Olefins | 5.01 |
| Naphthenes | 6.63 |
| Aromatics | 29.33 |
| Average Molecular Weight | 101.3 |

It is contemplated that the fuel composition of this invention may be used in spark-ignited internal combustion engines which operate on speciality oils which are formulated to suit the general combustion and other characteristics of the fuel. The fuel composition of this invention can generally be prepared by adding the cyclopentadienyl manganese antiknock compound, the $C_1$ to $C_6$ alcohols and/or the cosolvents, if any, to the base gasoline with sufficient agitation to give a uniform composition to the finished fuel. It is essential in the practice of this invention only that the novel combination of additives, a cyclopentadienyl manganese tricarbonyl and the $C_1$ to $C_6$ alcohols and/or cosolvent be present in the defined-proportions with unleaded gasoline bases immediately prior to vaporization and combustion of the fuel in the engine. Accordingly, it is within the scope of this invention to add the components to the base fuel either separately in any sequence, or as a mixture with each other, so long as the foregoing requirement is met.

Those skilled in the art will appreciate that many variations and modifications of the invention disclosed herein may be made without departing from the spirit and scope thereof.

Thus having disclosed our invention, we claim:

1. A fuel composition comprising:

an unleaded hydrocarbon base fuel having an olefinic content;

a cyclopentadienyl manganese tricarbonyl antiknock compound having a manganese concentration from about 0.001 to about 1.0 gram of elemental manganese per gallon of said fuel composition; and an oxygenate comprising 0.05 to 14.2 weight percent oxygen of the fuel composition and selected from the group consisting of methanol and ethanol and mixtures thereof, wherein a boiling temperature is associated with the T50 distillate fraction of said fuel composition which is at least 175° F. and is also greater than a corresponding maximum boiling temperature of the Technical Enleanment Region associated with said distillate fraction.

2. A fuel composition in accordance with claim 1 wherein the unleaded hydrocarbon base fuel has a saturate content of from 40% to 80% by volume of the base fuel and the boiling temperature associated with the T50 distillate fraction is greater than 175° F.

3. A fuel composition in accordance with claim 2 wherein the olefinic content is from 1% to 12% by volume of the base fuel.

4. A fuel composition in accordance with claim 2 wherein the aromatic content is at least 15% by volume of the base fuel.

5. A fuel composition in accordance with claim 2 wherein the boiling temperature of the T50 distillate fraction is less than 240° F.

6. A fuel composition in accordance with claim 1, wherein said oxygenate comprises 1.0 to 5.0% oxygen by weight of the fuel composition.

7. A fuel composition in accordance with claim 6 wherein said fuel composition has a manganese concentration in the form of methyl cyclopentadienyl manganese tricarbonyl of from 0.001 to 0.25 grams manganese per gallon of said fuel composition.

8. A fuel composition in accordance with claim 7 wherein said oxygenate is ethanol.

9. A fuel composition in accordance with claim 7 wherein said fuel composition has a manganese concentration of from 0.001 to 0.0625 grams manganese per gallon of said fuel composition.

10. A fuel composition in accordance with claim 9 wherein said fuel composition has a manganese concentration of from 0.001 to 0.3125 grams manganese per gallon of said fuel composition.

11. A fuel composition in accordance with claim 2, wherein a boiling temperature of the T40 distillate fraction is greater than 160° F. and is also greater than a corresponding maximum boiling temperature of the Technical Enleanment region associated with said distillate fraction.

12. A fuel composition comprising:

an unleaded hydrocarbon base fuel having an olefinic content;

a cyclopentadienyl manganese tricarbonyl antiknock compound having a manganese concentration from about 0.001 to about 1.0 gram of elemental manganese per gallon of said fuel composition;

a first oxygenate comprising selected from the group consisting of $C_1$ to $C_6$ aliphatic alcohols; and a second oxygenate different from said first oxygenate and selected from the group consisting of $C_2$ to $C_{12}$ alcohols, $C_3$ to $C_{12}$ ketones, $C_2$ to $C_{12}$ ethers, and mixtures thereof, wherein a boiling temperature is associated with the T50 distillate fraction of said fuel composition which is at least 175° F. and is also greater than a corresponding maximum boiling temperature of the Technical Enleanment Region associated with said distillate fraction.

13. A fuel composition in accordance with claim 12 wherein the unleaded hydrocarbon base fuel has a saturate content of from 40% to 80% by volume of the base fuel, an olefinic content from 1.0% to 30.0% by volume of the base fuel and wherein the boiling temperature associated with the T50 distillate fraction is greater than 175° F.

14. A fuel composition in accordance with claim 12, wherein said first oxygenate is selected from the group consisting of $C_1$ to $C_3$ aliphatic alcohols, the total oxygen concentration of said fuel composition is from 0.05 to 14.2 percent by weight, and said fuel composition has a manganese concentration of from 0.001 to 0.50 grams manganese per gallon of said fuel composition.

15. A fuel composition in accordance with claim 14, wherein said manganese is methyl cyclopentadienyl manganese tricarbonyl which is present in said fuel composition in a concentration of from 0.001 to 0.0625 grams manganese per gallon of said fuel composition.

16. A fuel composition in accordance with claim 14 wherein said second oxygenate is selected from the group consisting of $C_2$–$C_8$ alcohols, $C_2$–$C_8$ ethers, $C_3$–$C_8$ ketones, and mixtures thereof.

17. A fuel composition in accordance with claim 16 wherein said second oxygenate is selected from the group of branched chain ethers, straight chain ethers, cyclic ethers and mixtures thereof.

18. A fuel composition comprising:

an unleaded hydrocarbon base fuel having an olefinic content;

a cyclopentadienyl manganese tricarbonyl antiknock compound having a manganese concentration from about 0.001 to about 2.0 grams of elemental manganese per gallon of said fuel composition; and an oxygenate selected from the group consisting of ethanol and methanol and mixtures thereof, wherein a boiling temperature is associated with the T30 distillate fraction of said fuel composition which is at least 130° F. and is also greater than a corresponding maximum boiling temperature of the Technical Enleanment Region associated with said distillate fraction.

19. A fuel composition in accordance with claim 18 wherein the unleaded hydrocarbon base fuel has a saturate content of from 40% to 80% by volume of the base fuel an olefinic content from 1.0% to 30.0% by volume of the base fuel, said oxygenate includes oxygen comprising 0.5 to 14.2% oxygen by weight of the fuel composition and wherein the boiling temperature associated with the T30 distillate fraction is greater than 130° F.

20. A fuel composition in accordance with claim 19, wherein the olefinic content is at most 10.0% by volume of the base fuel.

21. A fuel composition in accordance with claim 20, wherein said hydrocarbon base fuel has a Reid vapor pressure of at most 7.2 psi.

22. A fuel composition in accordance with claim 19 wherein said oxygenate is ethanol and said fuel composition has a manganese concentration of 0.001 to 0.25 gram of manganese per gallon of said fuel composition.

23. A fuel composition in accordance with 18, wherein said unleaded hydrocarbon base fuel has a sulfur content of no more than 0.1 weight percent.

24. A fuel composition in accordance with claim 18 wherein said hydrocarbon base fuel contains alkylated hydrocarbons.

25. A fuel composition in accordance with claim 18 wherein said hydrocarbon base fuel has an end boiling temperature of at least 380° F.

26. A fuel composition in accordance with claim 18 wherein the boiling temperature of the T20 distillate fraction is greater than 110° F., the boiling temperature of the T40 distillate fraction is greater than 160° F., and the T20 and T40 distillate fractions are each greater than the corresponding boiling temperatures of the Technical Enleanment region associated with said distillate fraction.

27. A method of minimizing technical enleanment, said method comprising the step of:

providing an fuel composition including (a) an unleaded hydrocarbon base fuel containing olefins, (b) a cyclopentadienyl manganese tricarbonyl antiknock compound having a manganese concentration from about 0.001 to about 1.0 gram of manganese per gallon of said fuel composition, and (c) an oxygenate selected from the group consisting of $C_1$ to $C_6$ aliphatic alcohols, $C_2$ to $C_7$ ethers, and mixtures thereof, wherein a boiling temperature is associated with the T50 distillate fraction of said fuel composition is at least 175° F. and is also greater than the maximum boiling temperature of the Technical Enleanment Region associated with said distillate fraction.

28. A method in accordance with claim 27 wherein the oxygenate is selected from the group consisting of $C_1$ to $C_6$ aliphatic alcohols, $C_2$ to $C_7$ aliphatic ethers, and mixtures thereof, the unleaded hydrocarbon base fuel has a saturate content of from 40% to 80% by volume of the base fuel and the boiling temperature associated with the T50 distillate fraction is greater than 175° F.

29. A method in accordance with claim 28 wherein oxygen of the selected oxygenate comprises 0.05 to 14.2 weight percent of the fuel composition.

30. A method in accordance with claim 29 wherein the oxygen content of said composition is at most 2.5 weight percent.

31. A method in accordance with claim 29 wherein the oxygen content of said composition is from 1.0 to 5.0 weight percent.

32. A method in accordance with claim 28 wherein the aromatic content is at least 15% by volume of the base fuel.

33. A method in accordance with claim 28 wherein said fuel composition has a manganese concentration of from 0.001 to 0.25 grams per gallon of said fuel composition.

34. A method in accordance with claim 33 wherein said fuel composition has a manganese concentration of from 0.001 to 0.0625 grams per gallon of said fuel composition.

35. A method in accordance with claim 28, wherein the olefinic content of said hydrocarbon base fuel is from 1.0% to 30.0% by volume of said base fuel.

36. A method in accordance with claim 35 wherein the olefinic content is no greater than 10% by volume of the base fuel.

37. A method in accordance with claim 35, wherein said oxygenate is ethanol.

38. A method in accordance with claim 31 wherein said olefinic content is present in a concentration of from 1.0 to 12.0 volume percent of said base fuel.

39. A method in accordance with claim 27 wherein said hydrocarbon base fuel has a Reid vapor pressure no greater than 7.2 psi.

40. A method in accordance with claim 27 wherein the oxygenate is selected from the group consisting of $C_1$ to $C_6$ alcohols and mixtures thereof and said method further includes the steps of:

combusting said composition in a spark ignited internal combustion engine of a vehicle;

producing combustion emissions; and exhausting said combustion emissions through a catalytic exhaust system, wherein said combustion emissions from said vehicle include hydrocarbon emissions of 0.41 grams per mile or less.

41. A method in accordance with claim 40 wherein the total oxygen concentration of the composition is from 1.0 to 5.0 weight percent, said manganese is methyl cyclopentadienyl manganese tricarbonyl in a concentration of from 0.001 to 0.03125 grams manganese per gallon of the fuel composition, and wherein said hydrocarbon base fuel contains aromatics of at least 15% by volume and a Reid vapor pressure not exceeding 7.2 psi.

42. A method in accordance with claim 27 wherein the unleaded hydrocarbon base fuel has a saturate content of from 40% to 80% by volume of the base fuel and the boiling temperature associated with the T50 distillate fraction is greater that 175° F.

43. A method in accordance with claim 27 wherein said composition has at least one distillate fraction selected from the group consisting of T20, T30 and T40 distillate fractions which boils at a temperature greater than 110° F., 130° F. and 160° F., respectively, and also a temperature greater than the corresponding boiling temperature of the Technical Enleanment region associated with said distillate fraction.

44. A method in accordance with claim 27 wherein said oxygenate is an ether selected from the group consisting of methyl tertiary butyl ether, ethyl tertiary butyl ether, methyl tertiary amyl ether, diisopropyl ether, ethylene dimethyl ether, ethylene glycol dibutyl ether, and mixtures thereof.

45. A method in accordance with claim 44 wherein said oxygenate represents 1.0 to 5.0 weight percent oxygen of the composition, said hydrocarbon includes an aromatic content of at least 15% by volume, has a Reid vapor pressure of at most 7.2 psi, an end boiling point temperature of at least 380° F., and a manganese concentration of 0.001 to 0.03125 grams manganese per gallon of the composition.

46. A method in accordance with claim 45 wherein said hydrocarbon base fuel has an olefinic content of up to 2.5% by volume.

47. A method in accordance with claim 27 wherein said manganese concentration is from 0.001 to 0.03125 grams manganese per gallon of fuel composition.

48. A method in accordance with claim 27 wherein said hydrocarbon base fuel contains alkylated hydrocarbons.

49. A method in accordance with claim 27 wherein the sulfur content is 0.1 weight percent or less of said hydrocarbon base fuel.

50. A method in accordance with claim 27 wherein the sulfur content is 0.02 weight percent or less of said hydrocarbon base fuel.

51. A method in accordance with claim 27 wherein the end boiling point of said hydrocarbon base fuel is from 380° F. to 480° F.

52. A method in accordance with claim 27 wherein the Reid vapor pressure of said hydrocarbon base fuel is 7.2 psi.

* * * * *